US006265816B1

(12) United States Patent
Ito et al.

(10) Patent No.: US 6,265,816 B1
(45) Date of Patent: Jul. 24, 2001

(54) SPARK PLUG, INSULATOR FOR SPARK PLUG AND PROCESS FOR FABRICATING THE INSULATOR

(75) Inventors: Hirohito Ito; Hiroyuki Tanabe, both of Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 09/301,319

(22) Filed: Apr. 29, 1999

(30) Foreign Application Priority Data

Apr. 30, 1998 (JP) ..... 10-121448

(51) Int. Cl.[7] ..... H01T 13/20

(52) U.S. Cl. ..... 313/141; 313/142; 313/143; 313/136; 313/137

(58) Field of Search ..... 313/141, 142, 313/143, 136, 137

(56) References Cited

U.S. PATENT DOCUMENTS 4,601,991 * 7/1986 Ando et al. ..... 501/153

FOREIGN PATENT DOCUMENTS 0 190 768 * 8/1986 (EP) .
0 673 023 * 9/1995 (EP) .
55-3320 * 1/1980 (JP) .
61-183163 * 8/1986 (JP) .
62-260766 * 11/1987 (JP) .
63-190753 * 8/1988 (JP) .
1-119557 * 5/1989 (JP) .
1-221879 9/1989 (JP) .
2-180747 * 7/1990 (JP) .
2-243560 * 9/1990 (JP) .
3-166292 * 7/1991 (JP) .
5-124855 * 5/1993 (JP) .
5-301760 * 11/1993 (JP) .
5-327146 * 12/1993 (JP) .
8-119720 * 5/1996 (JP) .
9-227222 9/1997 (JP) .

OTHER PUBLICATIONS

Patent Abstracts of Japan, vol. 1998, No. 01, Jan. 30, 1998 & JP 09 227222 A (NGK Spark Plug Co., Ltd.) Sep. 2, 1997 (Abstract).

Patent Abstracts of Japan, vol. 013, No. 539 (E–853), Nov. 30, 1989 & JP 01 221879 A (NGK Spark Plug Co., Ltd.) Sep. 5, 1989 (Abstract).

* cited by examiner

*Primary Examiner*—Vip Patel
*Assistant Examiner*—Kevin Quarterman
(74) *Attorney, Agent, or Firm*—Sughrue, Mion, Zinn, Macpeak & Seas, PLLC

(57) ABSTRACT

The invention provides a spark plug having an insulator which is composed mainly of alumina, and which is more superior in voltage endurance characteristics at high temperatures as compared with the prior-art materials. An insulator 2 of a spark plug 100 is made of an insulating material which is composed mainly of alumina, and which contains Al component within a range of 95 to 99.7 wt % in weight converted to $Al_2O_3$, and in which an area ratio occupied by alumina base principal-phase particles with particle size not less than 20 $\mu$m is not less than 50% as a cross-sectional structure of the insulator is observed. By making the alumina base principal-phase particles appropriately coarse like this, the voltage endurance characteristics of the insulator can be remarkably improved.

17 Claims, 10 Drawing Sheets

SPARK PLUG, INSULATOR FOR SPARK PLUG AND PROCESS FOR FABRICATING THE INSULATOR

RELATED APPLICATION

This application claims the priority of Japanese Patent Application No. 10-121448 filed on Apr. 30, 1998, which is incorporated herein by reference.

BACKGROUND OF THE INVENTION

The present invention relates to a spark plug used for the ignition of an internal combustion engine, an insulator used in the spark plug as well as a process for fabricating the insulator.

In recent years, with the trend of higher output power of internal combustion engines used for automobiles and the like, the area occupied by suction and exhaust valves within the combustion chamber has been increasing. On account of this, the spark plug for igniting air-fuel mixture is required to be smaller in size, and besides the temperature in the combustion chamber has a tendency to increase due to turbochargers or other supercharging equipment and the like. Therefore, as insulators for spark plugs, those made of alumina base insulating materials, which are superior in thermal resistance, are widely used. Another reason that alumina base insulators for spark plugs are used is that alumina is superior in voltage endurance characteristics at high temperatures. However, in recent years, because the insulator tends to be thinner in thickness with the aforementioned miniaturization of spark plugs , and insulators more superior in voltage endurance characteristics are demanded.

For example, in recent years, insulators in which the alumina content is increased to 85 wt %, in some cases, 90 to 97 wt % for improvement in voltage endurance characteristics have been used (hereinafter, insulators having such high alumina contents will be referred to as high alumina insulators). However, in the present technical background, effects of the improvement in voltage endurance characteristics have not been achieved so remarkably for the increase in the alumina content. The reason of this could be that in conventional high alumina insulators, materials have not been sufficiently densified due to lack of sintering aid components, or even if densified, minute open voids are remaining in relatively large amounts so that effects of increasing in the alumina content on the voltage endurance characteristics are reduced.

Therefore, in Japanese Patent Laid-Open Publication SHO 63-190753, there has been disclosed an alumina insulator in which fine alumina powder having a mean particle size of approximately 0.1 to 0.5 $\mu$m is used as a raw material, to which at least one of $Y_2O_3$, MgO and $La_2O_3$ is blended as a sintering aid, so that the alumina content is raised to approximately 95 wt % with the result that the voltage endurance characteristics can be improved correspondingly. As the reasons of the improvement in the voltage endurance characteristics, the publication describes that the insulator is less prone to initial deterioration by virtue of the formation of a high-melting-point grain boundary phase based on the aforementioned sintering aid components, and that the formation of the grain boundary phase suppresses the growth of alumina crystal grains, making the structure microfine, with the result that grain boundary portions serving as electrical conduction paths are elongated and bypassed.

However, in the insulator of this patent laid-open publication, because the mean particle size of alumina crystal grains is as microfine as 1 $\mu$m or less, there is a tendency that large amounts of residual voids that adversely affect the voltage endurance are involved in the insulator. Further, the publication also describes that the voltage endurance is improved notwithstanding high rates of voids by virtue of the formation of the high-melting-point grain boundary phase. However, it is essentially impossible to completely eliminate the effect of voids, and the upper limit of the content of alumina directly contributing to the improvement in voltage endurance could be around 95 wt % as shown in Examples of the patent laid-open publication. In conclusion, with alumina-richer compositions adopted for further improvement in voltage endurance, the rate of voids would increase more and more, while the high- melting-point grain boundary phase that suppresses the effects of the increased rate of voids, so that satisfactory voltage endurance characteristics could no longer be expected.

SUMMARY OF THE INVENTION

An object of the present invention is to provide a spark plug having an insulator more superior in voltage endurance characteristics at high temperatures, as compared with the prior-art materials, as well as an insulator to be used in the spark plug.

In order to achieve the above object, in a first aspect, the present invention provides a spark plug comprising:

a center electrode;

a metallic shell placed outside the center electrode;

a ground electrode which has one end coupled to the metallic shell and which is placed opposite to the center electrode; and an insulator placed between the center electrode and the metallic shell so as to cover exterior of the center electrode, wherein the insulator is made of an insulating material which is composed mainly of alumina, and which contains Al component within a range of 95 to 99.7 wt % in $Al_2O_3$ -converted weight, and in which an area ratio occupied by alumina base principal-phase particles with particle size not less than 20 $\mu$m is not less than 50% as a cross-sectional structure of the insulator is observed.

In a second aspect, the present invention provides a spark plug comprising:

A spark plug comprising:

a center electrode;

a metallic shell placed outside the center electrode;

a ground electrode which has one end coupled to the metallic shell and which is placed opposite to the center electrode; and an insulator placed between the center electrode and the metallic shell so as to cover exterior of the center electrode, wherein the insulator is made of an insulating material which is composed mainly of alumina, which contains Al component within a range of 95 to 99.7 wt % in $Al_2O_3$-converted weight, and in which a mean presence number per $mm^2$ in a cross section of voids having a size of not less than 10 $\mu$m observed in cross-sectional structure is less than 100.

The present invention also provides an insulator for spark plugs characterized by being formed from an insulating material which is composed mainly of alumina, and which contains Al component within a range of 95 to 99.7 wt % in weight converted to $Al_2O_3$, and in which an area ratio occupied by alumina base principal-phase particles with particle size not less than 20 $\mu$m is not less than 50% as a cross-sectional structure of the insulator is observed. It is noted that the "alumina base principal phase" refers to a phase containing 99.8 wt % or more of Al component in $Al_2O_3$ -converted weight.

The other object of the present invention is to provide process for fabricating the insulator for spark plugs of this invention. In a first aspect, the present invention provides a process for fabricating the insulator for spark plugs comprising:

preparing a raw material base powder (PG) by blending alumina powder having a mean particle size of not more than 1 μm with 0.3 to 5 wt % of additional-element material serving as sintering aids in a ratio relative to a total of the alumina powder and the additional-element material;

molding the raw material base powder (PG) into a specified insulator configuration; and firing the molded body at a temperature of 1450 to 1700° C., whereby an insulator in which an area ratio occupied by alumina base principal-phase particles with particle size not less than 20 pm is not less than 50% as a cross-sectional structure of the insulator is observed is obtained.

In a second aspect, the present invention provides a Process for fabricating the insulator for spark plugs comprising:

preparing a raw material base powder (PG) by blending alumina powder having a mean particle size of not more than 1 μm with 0.3 to 5 wt % of additional-element material serving as sintering aids in a ratio relative to a total of the alumina powder and the additional-element material;

molding the raw material base powder (PG) into a specified insulator configuration; and firing the molded body at a temperature of 1450 to 1700° C., whereby an insulator in which a mean presence number per $mm^2$ in a cross section of voids having a size of not less than 10 μm observed in cross-sectional structure is less than 100 is obtained.

DETAILED DESCRIPTION OF THE INVENTION

Figures 1, 1A:
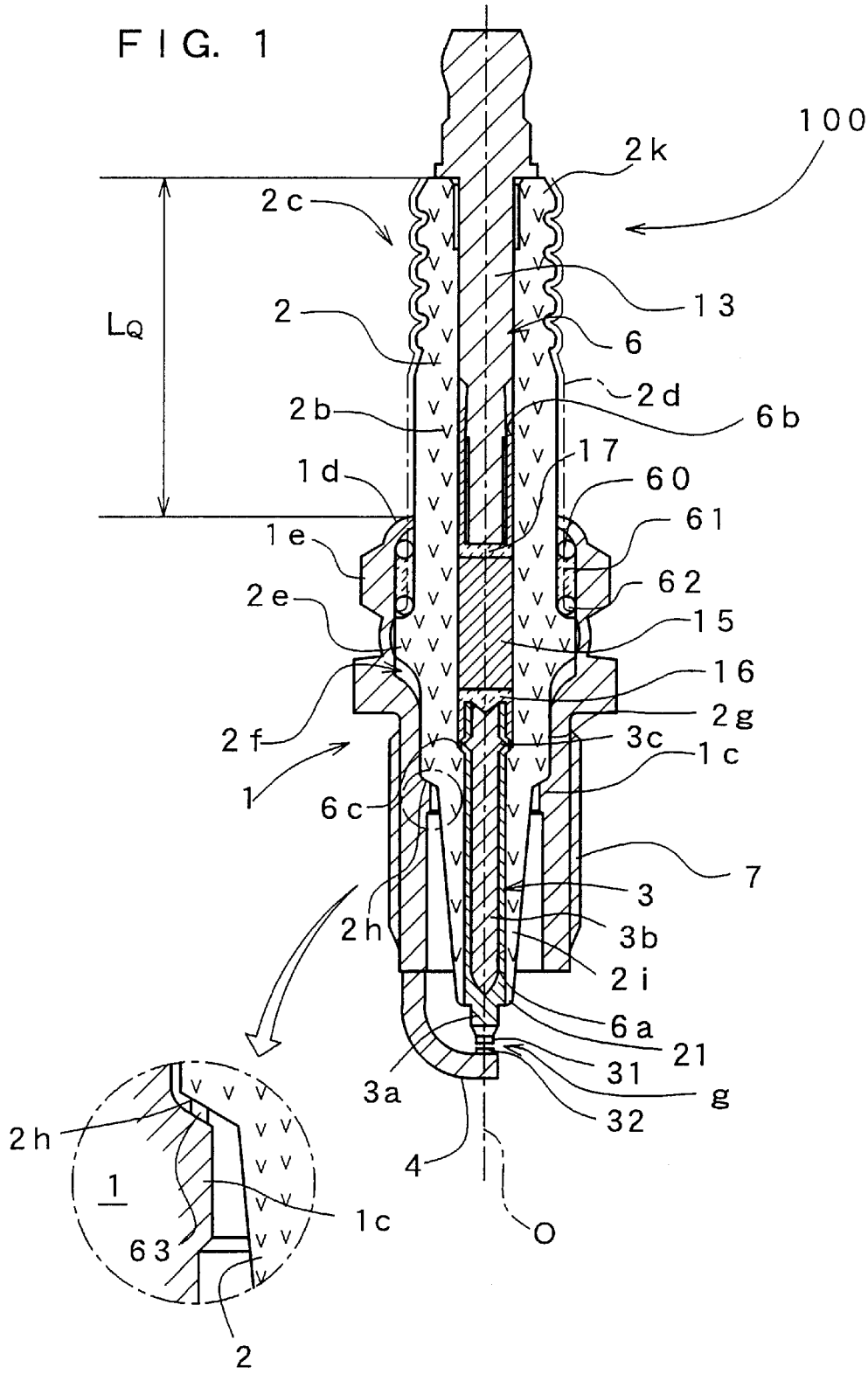
FIG. 1 is a general front sectional view showing an example of the spark plug of the present invention.

The present inventors, based on a concept just converse to the technique disclosed in aforementioned Japanese Patent Laid-Open Publication SHO 63-190753 have accomplished the present invention by finding that an insulator for spark plugs can be remarkably improved in voltage endurance characteristics by making up the insulator as one having a structure in which alumina base principal-phase particles are appropriately coarse, more concretely, a structure in which the area ratio occupied by the alumina base principal-phase particles with particle size not less than 20 μm is not less than 50%. By this invention, it becomes possible to provide an insulator which is superior in voltage endurance characteristics at both room temperature and high temperature, as compared with the prior-art spark plugs, and which can be effectively prevented from troubles such as dielectric breakdown even when applied to spark plugs for use in high output internal combustion engines involving high temperatures within the combustion chamber or when applied to miniature spark plugs involving a small thickness of the insulator.

The reason that the voltage endurance of the insulator according to the present invention is improved could be attributed to the fact that with increased volume fraction of the alumina base principal-phase particles having relatively large particle size not less than 20 μm, the amount of grain boundaries that easily make paths for breakdowns decrease, and besides the number of triple points of grain boundaries (at which glass phases derived from sintering aids are pooled, easily making start points of breakdowns) also decreases, for example. In addition, the area ratio is desirably not less than 60%.

This insulator for spark plugs can be fabricated by a process comprising: preparing a raw material base powder by blending alumina powder having a mean particle size of not more than 1 μm with 0.3 to 5 wt % of sintering aid components in a ratio relative to a total of the alumina powder and the sintering aid components; molding the raw material base powder into a specified insulator configuration; and baking the molded body at a temperature of 1450 to 1700° C. That is, also for the fabrication of the insulator for spark plugs according to the present invention, it is important to use alumina powder having a mean particle size of not more than 1 μm as the raw material alumina powder, like the technique of aforementioned Japanese Patent Laid-Open Publication SHO 63-190753. However, the reason of using such a fine powder of raw material alumina in the present invention is absolutely different from that of the technique of the patent laid-open publication.

That is, the technique of the patent laid-open publication placed the primary point on the grain growth of alumina crystal grains in the sintering process is suppressed by using specific additives, so that a microfine structure on which the mean particle size of raw material alumina is reflected is obtained. However, in the present invention, alumina base principal-phase particles are rather positively grown in the sintering process by setting the mean particle size of raw material alumina powder to not more than 1 μm, while the growth is made to progress uniformly by using microfine raw material alumina powder, thus allowing a structure having a sharp particle size distribution to be formed. As a result, despite being a high alumina matter and having less sintering aid components, densification of the sintered body notably progresses so that the amount of voids remaining in the structure also becomes extremely small, while the thermal conductivity is enhanced. Thus, superior voltage endurance characteristics can be obtained.

For example, the raw material powder for fabricating the insulator may be one in which 95 to 99.7 parts by weight of alumina powder is blended with 0.03 to 5 parts by weight of an additional-element material containing one or more kinds selected from a group consisting of Si, Ca, Mg, Ba and B serving as sintering aids in oxide weight converted to $SiO_2$ for Si, CaO for Ca, MgO for Mg, BaO for Ba, and $B_2O_3$ for B, respectively. The insulator thus obtained contains additional-element components of one or more kinds selected from a group consisting of Si, Ca, Mg, Ba and B in oxide weight converted to $SiO_2$ for Si, CaO for Ca, MgO for Mg, BaO for Ba, and $B_2O_3$ for B, respectively. In this case, sintering aid components that extremely suppress the growth of the alumina base principal-phase particles as in the technique of the aforementioned patent laid-open publication are not preferable for use in the present invention.

As to the additional-element material, in addition to oxides (or complex oxides) of the components of Si, Ca, Mg and Ba, which are usable for those components themselves, various types of inorganic raw material powders such as hydroxides, carbonates, chlorides, sulfates, nitrates and phosphates are usable. In this case, it is necessary to use these inorganic raw material powders that can be changed into oxides by calcination orsintering. Also, for the B component, in addition to diboron trioxide ($B_2O_3$), various types of boric acids such as orthoboric acid ($H_3BO_3$) and further borates with Al, Ca, Mg, Ba and the like, which are principal-component elements of the insulator, may be used.

The additional-element components melt in the sintering process to yield a liquid phase, thus serving as sintering aid that accelerates densification. If the total content (hereinafter, expressed as Wi) of additional element components in the insulator in oxide-converted weight is less than 0.03 wt %, then it becomes difficult to densify the sintered body, so that the material lacks in high temperature strength and high-temperature voltage endurance characteristics undesirably. Meanwhile, if WI is more than 5 wt %, it becomes impossible to maintain the alumina content to a value not less than 95 wt %, so that the effects of the present invention can no longer be achieved. Therefore, with total content WI of additional-element components is preferable 0.03 to 5 wt %, more desirably, 0.03 to 3 wt %.

Among the above components, Ba and B components also have an effect of remarkably improving the high temperature strength of the insulator. Then, the Ba component is preferably contained in an amount of 0.02 to 0.3 wt % in BaO-converted weight (hereinafter, expressed as WBaO). If the WBaO is less than 0.02 wt %, the effect of blending BaO on the improvement in high temperature strength becomes unremarkable. Also, if WBaO is more than 0.3 wt %, the high temperature strength of the material may be impaired. WBaO is desirably adjusted within a range of 0.02 to 0.2 wt %. Meanwhile, the B component is preferably contained in an amount of 0.01 to 0.25 wt % in $B_2O_3$ -converted weight (hereinafter, expressed as $WB_2O_3$). If $WB_2O_3$ is less than 0.01 wt %, the effect of blending $WB_2O_3$ on the improvement in high temperature strength becomes unremarkable. Also, if $WB_2O_3$ is more than 0.25 wt% , the high temperature strength of the material may be impaired. $WB_2O_3$ is desirably adjusted within a range of 0.01 to 0.15 wt %.

In addition, for the additional-element components to function more effectively as sintering aid, it is important to generate a liquid phase successful in fluidity without any lacks or excesses at a specified sintering temperature which is set lower than $Al_2O_3$. This fulfills an important role in obtaining a structure specific to the insulator for spark plugs according to the present invention, i.e., a structure in which "an area ratio occupied by alumina base principal-phase particles with particle size not less than 20 $\mu$m is not less than 50% as a cross-sectional structure of the insulator is observed". This is because generating a liquid phase successful in fluidity makes it possible to accelerate smooth and uniform growth of the alumina base principal-phase particles.

In this case, if a plurality of additional-element components in a plurality of types are blended together, fluidity of the resultant liquid phase or its wettability with alumina base principal-phase particles or the like is improved, which in turn produces an effect on obtaining a successful structure. As an example, the aforementioned five types of additional-element materials are blended at the following ratios relative to the total of alumina powder and the additional-element materials:

Si component: 0.15 to 2.5 wt % in $SiO_2$-converted weight;

Ca component: 0.12 to 2.0 wt % in CaO-converted weight;

Mg component: 0.01 to 0.1 wt % in MgO-converted weight;

Ba component: 0.02 to 0.3 wt % in BaO-converted weight; and

B component: 0.01 to 0.25 wt % in $B_2O_3$-converted weight, by which it becomes possible to achieve the effects remarkably. In this case, the insulator finally obtained is made of an insulating material containing 0.15 to 2.5 wt % of Si component in $SiO_2$-converted weight, 0.12 to 2.0 wt % of Ca component in CaO-converted weight, 0.01 to 0.1 wt % of Mg component in MgO-converted weight, 0.02 to 0.3 wt % of Ba component in BaO-converted weight, and 0.01 to 0.25 wt % of B component in $B_2O_3$-converted weight.

In this case, the Ba and B components can be regarded as not only having an effect of improving the high temperature strength of the insulator, but also playing a large part in enhancing the fluidity of the liquid phase generated in the sintering process to form the aforementioned structure specific to the insulator for spark plugs according to the present invention.

Next, in the first aspect of the spark plug and the insulator for spark plugs as described above, when the mean presence number of voids having a size of not less than 10 $\mu$m per mm in a cross section observed in cross-sectional structure is less than 100, the voltage endurance characteristics of the material can be improved remarkably. This could be attributed to a decrease in places which can be start points of dielectric breakdowns with high voltage applied. Desirably, the presence number of the voids is not more than 90.

In a second aspect of the spark plug and the insulator for spark plugs according to the present invention, the insulator is made of an insulating material which is composed mainly of alumina, and which contains Al component within a range of 95 to 99.7 wt % in $Al_2O_3$-converted weight, and in which a mean presence number per mm2 in a cross section of voids having a size of not less than 10 $\mu$m observed in cross-sectional structure is less than 100.

Also, in the first and second aspects of the insulator according to the present invention, by accelerating the densification of the insulating material and controlling the structure as described above, a high thermal conductivity as much as 25 W/m·K or more can be ensured. As a result, the insulator becomes more heat sinkable and satisfactory in heat resistance, thus being improved in voltage endurance characteristics at high temperatures. Further, whereas with high voltage applied to the insulator, Joule heat is generated due to leak current, if the Joule heat is accumulated in the insulator without being progressively radiated, the insulator increases in temperature and decreases in resistance value, incurring a further increase in the leak current. As a result, by a multiplier effect, as it were, of the temperature increase in the insulator due to the Joule heat and the leak-current increase due to the decrease in the insulation resistance value, the leak current rapidly increases, which may result in a dielectric breakdown. Such a phenomenon is generally called thermal runaway. Then, setting the thermal conductivity to not less than 25 W/m·K makes the heat radiation from the insulator easier to progress, which is in turn effective for preventing or suppressing the thermal runaway. In addition, the thermal conductivity is desirably ensured to be 28 W/m·K or more.

Figure 9:
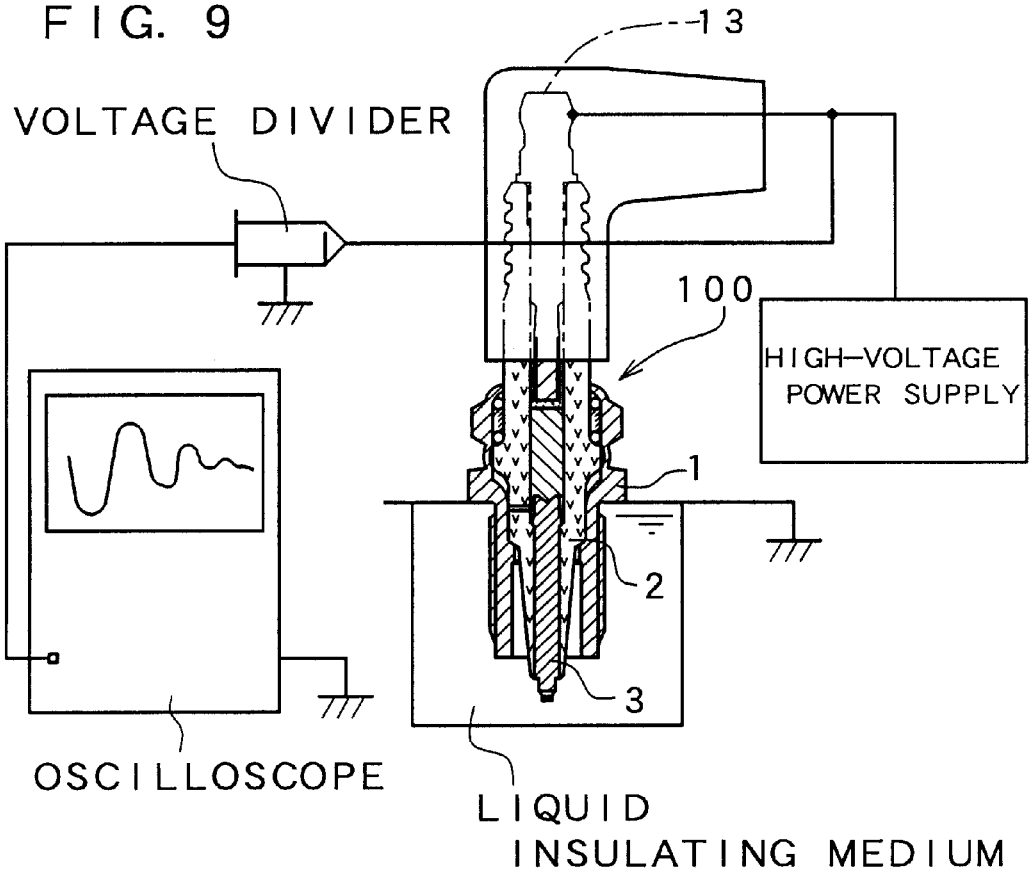
FIG. 9 is an explanatory view showing a method for measuring dielectric withstand voltage.

Next, for the insulator, the value of through breakdown voltage at 20° C. is desirably not less than 37 kV from the viewpoint of ensuring the durability of the insulator, particularly the durability for through breakdowns. It is noted that the dielectric withstand voltage of the insulator can be measured by the following manner. That is, as shown in FIG. 9, a ground electrode is removed from a metallic shell 1 of a spark plug 100, in which state the opening side of the metallic shell 1 is dipped in a liquid insulating medium such as silicone oil, so that the gap between the outer face of the insulator 2 and the inner face of the metallic shell 1 is filled with the liquid insulating medium so as to be insulated from each other. In this state, a DC impulse high voltage is applied between the metallic shell 1 and a center electrode 3 with a high-voltage power supply, while the resulting voltage waveform (stopped down at a proper factor by voltage divider) by oscilloscope or the like. Then, a voltage value VD at the time when a through breakdown occurs to the insulator 2 is read from the voltage waveform, and taken as a through breakdown voltage.

Next, the insulating material constituting the insulator may contain, as auxiliary additional-element components together with the aforementioned additional-element components, element components of one or more kinds selected from a group consisting of Sc, V, Mn, Fe, Co, Cu and Zn in a total amount of 0.1 to 2.5 wt % (desirably, 0.2 to 0.5 wt %) in oxide-converted weight. This produces an effect particularly on the improvement in voltage endurance characteristics at high temperatures of the insulator. The addition of Mn component among the above components shows a remarkable effect on the improvement in voltage endurance characteristics, thus being preferred for the present invention.

Whereas Mn component (or MnO) can be expected to exhibit an improvement effect on voltage endurance characteristics even when used singly, co-adding the Mn component together with Cr component (or $Cr_2O_3$) allows the improvement effect on voltage endurance characteristics to be more remarkable. In this case, assuming the Mn component content in conversion to MnO is WMn (in wt %) and that the Cr component content in conversion to $Cr_2O_3$ is WCr (in wt %), the Mn and Cr components should be contained so that the value of WMn/WCr falls within a range of 0.1 to 10.0. If the value of WMn/WCr falls outside this range, the co-addition effect is not necessarily remarkable. In the case where only the Mn and Cr components are used as the auxiliary additional-element components, it is recommendable to control the value of WMn+WCr within a range of 0.1 to 2.5 wt %, desirably 0.2 to 0.5 wt %.

According to discussions by the present inventors, it has been proved that by co-adding Mn component and Cr component, a Mn—Al base composite oxide phase (e.g., Mn—Al base spinel phase) of high melting point is formed in the insulator. Whereas a glass phase based on the sintering aid components is formed so as to surround the alumina base principal phase in the insulator, this glass phase is higher in electrical conductivity than the primary phase, being said to be likely to make conduction paths in dielectric breakdowns. However, among the insulators of the present invention, in those having a composition in which Mn component and Cr component are co-added, it can be inferred that composite oxide phases of high melting point are formed dispersedly in the glass phase, making conductive paths cut off or bypassed and thus improving the dielectric breakdown withstand voltage.

As the additional-element components or auxiliary additional-element components are contained in the insulator primarily in the form of oxide, it is often impossible to discriminate the form of presence by oxide due to such factors as the formation of an amorphous glass phase. In such a case, if the total content of additional-element components in oxide-converted value is within the aforementioned range, the insulator is regarded as belonging to the scope of the present invention. Also, it can be verified whether or not Al component and additional-element components are contained in the insulator in the form of oxide, by the following (1) to (3) methods or their combinations:

(1) By X-ray diffraction, it is verified whether or not a diffraction pattern on which the crystalline structure of a specific oxide is reflected can be obtained;

(2) When component analysis by a known micro-analysis method such as EPMA (Electron Probe Micro-Analysis; for measurement of characteristics X-rays, either the wavelength dispersive or the energy dispersive may be used) or XPS (X-ray Photoelectron Spectroscopy) is conducted in the material cross section, it is verified whether or not Al component or additional-element components and oxygen component are simultaneously detected from cross-sectional regions presumed as the same phase. When they are simultaneously detected, it is concluded that Al component or additional-element components are present in the form of oxide; and (3) The valence number of atoms or ions of Al component or additional-element components is analyzed by a known method such as X-ray photoelectron spectroscopy (XPS) or Auger electron spectroscopy (AES). If these components are present in the form of oxide, the valence numbers of the components are measured as positive values.

Further, the spark plug of the present invention using the above insulator may be made up as one having, within a through hole of the insulator, a shaft-like terminal portion which is provided integrally with the center electrode on a rear-end side of the center electrode or separately from the center electrode with an electrically conductive coupling layer interposed therebetween. As a result, the spark plug is improved in voltage endurance characteristics for both room temperature and high temperatures, and moreover when the spark plug is applied to use in a high-output internal combustion engine involving a high-temperature combustion chamber, or when the spark plug is a miniature one with the thickness of the insulator reduced (for example, outer diameter of a mounting screw portion formed in the metallic shell is not more than 12 mm), the insulator is less prone to cause troubles such as through breakdowns.

In addition, the spark plug of the present invention may be made up as one having an igniter portion which is fixed to at least one of the center electrode and the ground electrode to form a spark discharge gap. As a result, even when the spark plug is applied to high-output internal combustion engines, durability of the igniter portion can be improved remarkably. In this case, an alloy constituting the igniter portion may be given by a noble metal alloy composed mainly of one or more kinds selected from a group consisting of Ir, Pt and Rh.

Hereinbelow, several embodiments of the present invention are described with reference to the accompanying drawings.

Figure 2:
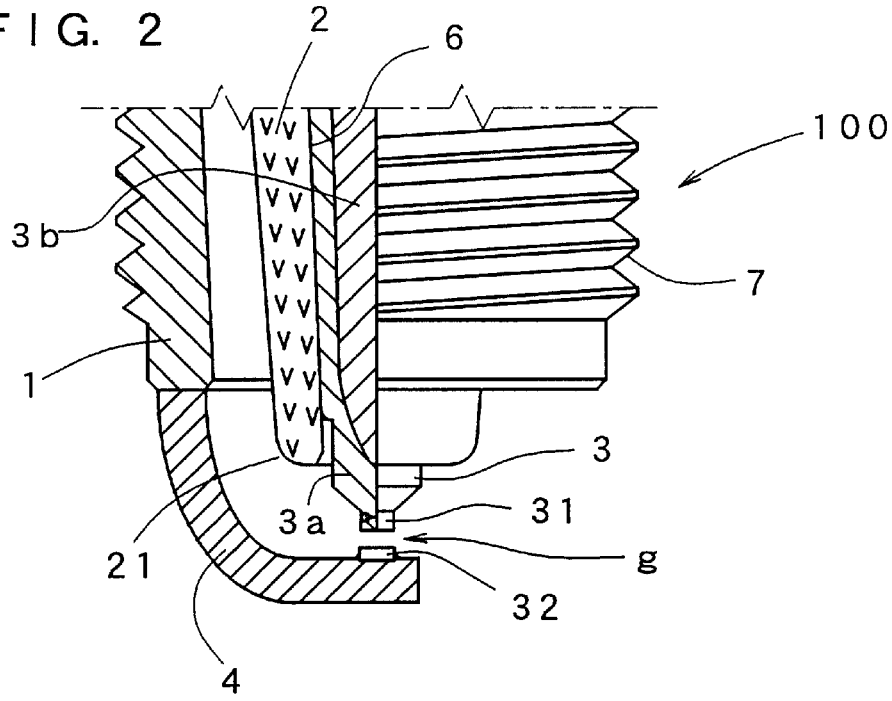
FIG. 2 is a front partial sectional view of an essential part of FIG. 1.

A spark plug 100 as an example of the present invention shown in FIGS. 1 and 2 comprises a cylindrical metallic shell 1, an insulator 2 fitted inside the metallic shell 1 so that a front portion 21 of the insulator 2 is projected, a center electrode 3 provided inside the insulator 2 in a state that an igniter portion 31 formed at a tip end is projected, a ground electrode 4 one end of which is coupled to the metallic shell 1 by welding or the like and the other end of which is folded back sideways so that a side face of the ground electrode 4 is opposed to the tip-end portion of the center electrode 3, and the like. Also, the ground electrode 4 has an igniter portion 32 opposed to the igniter portion 31, where a gap is formed between the igniter portion 31 and the opposite igniter portion 32 as a spark discharge gap g.

A through hole 6 is formed axially in the insulator 2, and a terminal 13 is inserted and fixed on one end side of the through hole 6, while the center electrode 3 is similarly inserted and fixed on the other end side of the through hole 6.Also, a resistor 15 is placed between the terminal 13 and the center electrode 3 within the through hole 6. Both end portions of the resistor 15 are electrically connected to the center electrode 3 and the terminal 13 via electrically conductive glass seal layers 16, 17, respectively. It is noted that the resistor 15 is formed from a resistor composition obtained by mixing glass powder and electrically conductive material powder (and, as required, ceramic powder other than glass) together and sintering the mixture by hot pressing or other process. The conductive glass seal layer 17 is formed from a glass mixed with metal powder composed mainly of one or more kinds selected from among Cu, Sn, Fe and the like. In addition, the resistor 15 may be omitted, where the terminal 13 and the center electrode 3 are coupled together by a single-layer electrically conductive glass seal layer.

Figure 8:
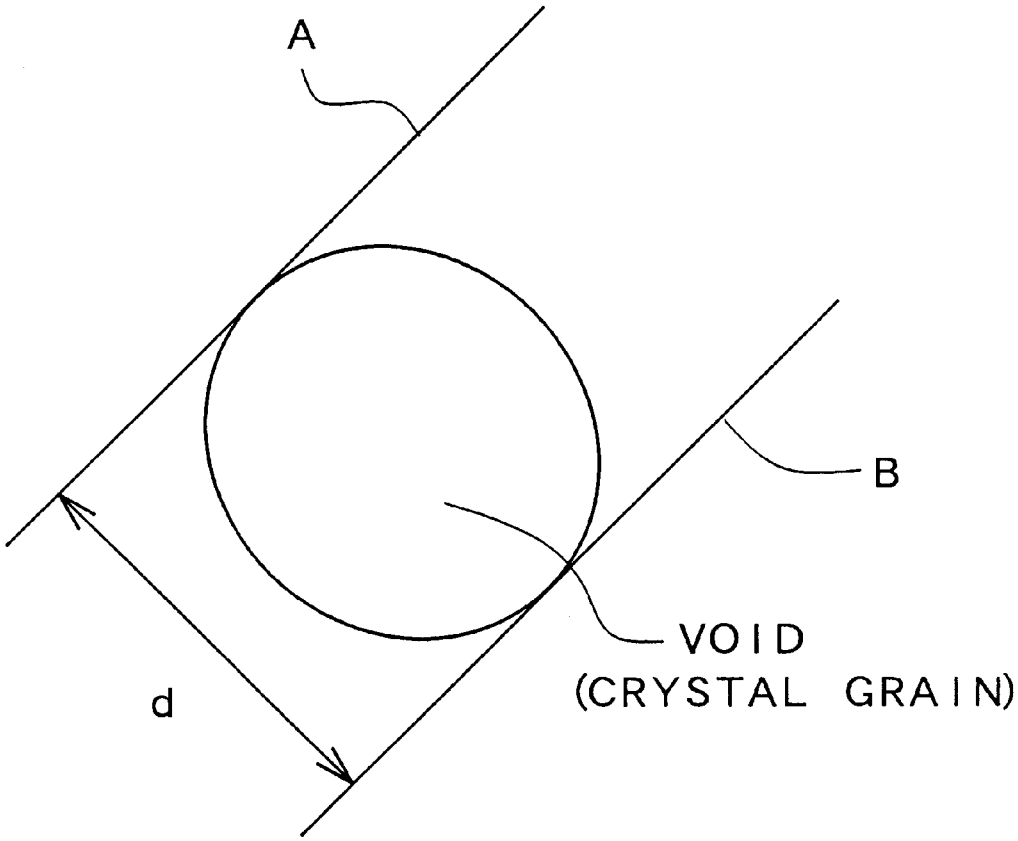
FIG. 8 is a view for explaining the definition of the size of a void or a crystal grain of the alumina base principal phase present in the insulator.

The insulator 2 has, in its interior, the through hole 6 for fitting the center electrode 3 along the axial direction of the insulator 2 itself, and is made up, as a whole, by the insulator of the present invention. More specifically, the insulator 2 is made of an insulating material which is composed mainly of alumina, and which contains Al component within a range of 95 to 99.7 wt % (desirably, 97 to 99.7 wt %) in $Al_2O_3$-converted weight, and in which an area ratio occupied by alumina base principal-phase particles with particle size not less than 20 $\mu$m is not less than 50% (desirably, not less than 60%) as a cross-sectional structure of the insulator is observed. In the insulating material, desirably, the mean presence number per $mm^2$ in a cross section of voids having a size of not less than 10 pm observed in cross-sectional structure is not more than 100 (desirably, not more than 90). Also, the thermal conductivity at 25° C. is preferably not less than 25 W/m·K (desirably, not less than 28 W/m·K). In this specification, the terms, "size of voids" or "size of alumina base principal-phase particles", are herein defined as a maximum value d between two parallel lines A and B, the maximum value d resulting when the parallel lines A, B are drawn, in various types, so as to be tangent to a profile of a void or particle observed on the cross section and not to cross the inside of the void or particle while the positional relationship with the void or particle is varied, as shown in FIG. 8.

Concrete compositions for the components other than Al are exemplified by the following:

Si component: 0.15 to 2.5 wt % in $SiO_2$-converted weight;

Ca component: 0.12 to 2.0 wt % in CaO-converted weight;

Mg component: 0.01 to 0.1 wt % in MgO-converted weight;

Ba component: 0.02 to 0.3 wt % in BaO-converted weight; and

B component: 0.01 to 0.25 wt % in $B_2O_3$-converted weight.

Next, as shown in FIG. 1, a protruding portion 2*e* protruding circumferentially outward is formed, for example, in a flange shape axially halfway of the insulator 2. Then, one side of the insulator 2 directed toward the tip end of the center electrode 3 (FIG. 1) being assumed as the front side, the insulator 2 is formed, on the rear side of the protruding portion 2*e*, into a shell portion 2*b* smaller in diameter than the protruding portion 2*e*. On the front side of the protruding portion 2*e*, a first stem portion 2*g* smaller in diameter than the protruding portion 2*e*, and a second stem portion 2*i* further smaller in diameter than the first stem portion 2*g* are formed in this order. In addition, the shell portion 2*b* is coated at its outer circumferential surface with a glaze 2*d*, and a corrugation 2*c* is formed at a rear end portion of the outer circumferential surface. Further, the outer circumferential surface of the first stem portion 2*g* is formed into a generally cylindrical shape, and the outer circumferential surface of the second stem portion 2*i* is formed into such a generally conical shape as to decrease in diameter increasingly with increasing closeness to the tip end.

The axial cross-sectional diameter of the center electrode 3 is set smaller than the axial cross-sectional diameter of the resistor 15. Then, the through hole 6 of the insulator 2 has a generally cylindrical first portion 6*a* which allows the center electrode 3 to be inserted through, and a generally cylindrical second portion 6*b* formed on the rear side (upper side in the figure) of the first portion 6*a* so as to be larger in diameter than the first portion 6*a*. The terminal 13 and the resistor 15 are contained in the second portion 6*b*, and the center electrode 3 is inserted into the first portion 6*a*. In a rear end portion of the center electrode 3, an electrode-fixing protrusion 3*c* is formed so as to be protruded outward from the outer circumferential surface of the center electrode 3. Then, the first portion 6*a* and the second portion 6*b* of the through hole 6 are connected to each other within the first stem portion 2*g* of FIG. 4A, and at the connecting position, a protrusion receiving surface 6*c* for receiving the electrode-fixing protrusion 3*c* of the center electrode 3 is formed into a taper surface or round surface.

Further, an outer circumferential surface of a connecting portion 2*h* between the first stem portion 2*g* and the second stem portion 2*i* is formed into a stepped surface. This stepped surface is engaged via a ring-shaped plate packing 63 with a linear protruding portion 1*c* as an engaging portion on the metallic shell side formed at the inner surface of the metallic shell 1, by which the first stem portion 2*g* and the second stem portion 2*i* are prevented from axial loosening and falling off. On the other hand, a ring-shaped line packing 62 to be engaged with the rear-side peripheral edge of the flange-shaped protruding portion 2*e* is placed between the inner surface of the rear-side opening portion of the metallic shell 1 and the outer surface of the insulator 2, and on the further rear side of the line packing 62, a packing 60 is placed via a talc or other filler layer 61. Then, the insulator 2 is pushed in forward toward the metallic shell 1, in which state the opening edge of the metallic shell 1 is caulked inward toward the packing 60, by which a caulking portion 1*d* is formed and the metallic shell 1 is fixed to the insulator 2.

Figure 4A:
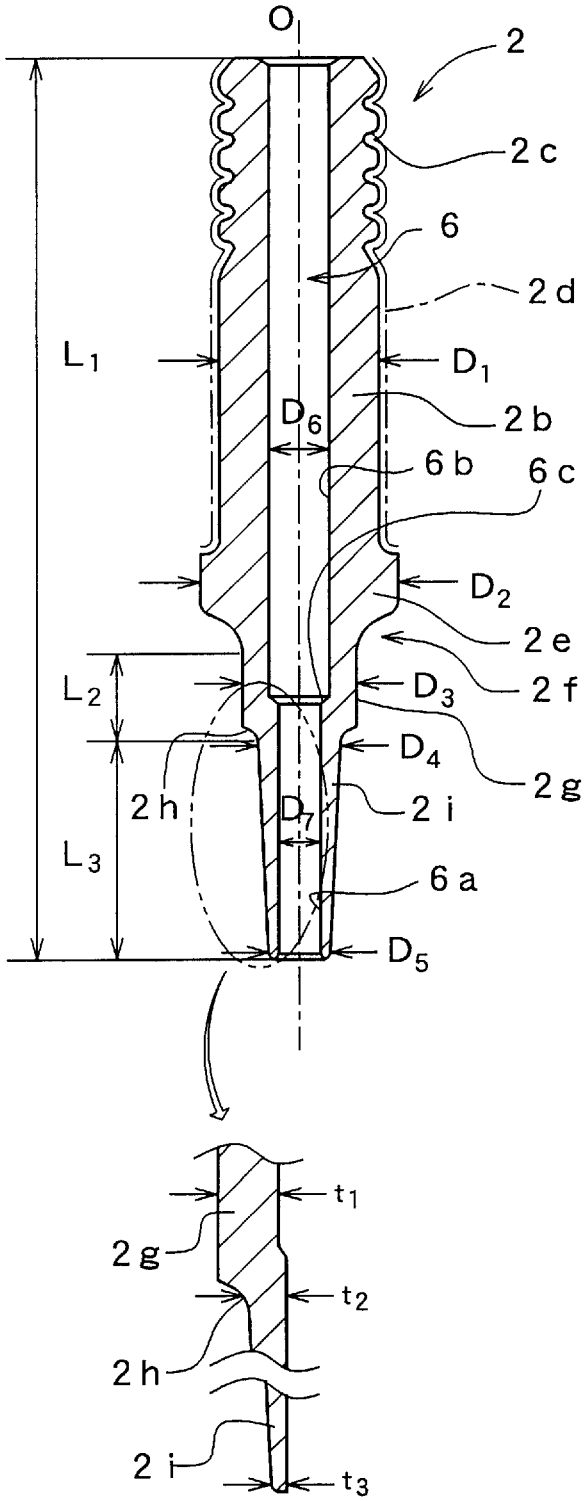
FIG. 4A is a longitudinal sectional view showing an example of the insulator.
Figure 4B:
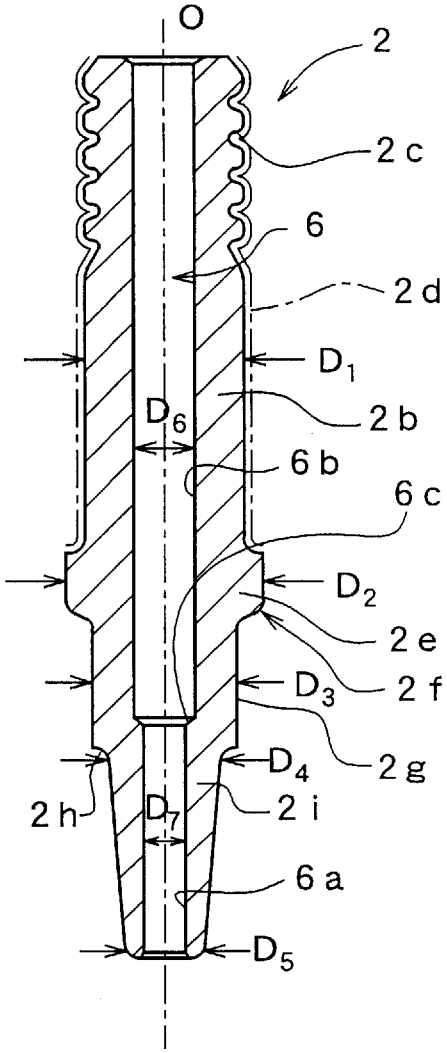
FIG. 4B is a longitudinal sectional view showing another example of the insulator.

FIGS. 4A and 4B show several examples of the insulator 2. The dimensions of individual parts of the insulator are, for example, as follows:

overall length L1: 30 to 75 mm;

length L2 of first stem portion 2*g*: 0 to 30 mm (not including a connecting portion 2*f* with the engagement protruding portion 2*e*, but including the connecting portion 2*h* with the second stem portion 2*i*);

length L3 of second stem portion 2*i*: 2 to 27 mm;

outer diameter D1 of shell portion 2: 9 to 13 mm;

outer diameter D2 of engagement protruding portion 2*e*: 11 to 16 mm;

outer diameter D3 of first stem portion 2*g*: 5 to 11 mm;

base-end portion outer diameter D4 of second stem portion 2*i*: 3 to 8 mm;

tip-end portion outer diameter D5 of second stem portion 2*i* (when the outer peripheral edge of the tip-end surface is rounded or chamfered, an outer diameter at the base-end position of the rounded portion or chamfered portion): 2.5 to 7 mm;

inner diameter D6 of second portion 6*b* of through hole 6: 2 to 5 mm;

inner diameter D7 of first portion 6*a* of through hole 6: 1 to 3.5 mm;

wall thickness t1 of first stem portion 2*g*: 0.5 to 4.5 mm;

base-end portion wall thickness t2 of second stem portion 2*i* (value in a direction perpendicular to a center axis line 0): 0.3 to 3.5 mm;

tip-end portion wall thickness t3 of second stem portion 2*i* (value in a direction perpendicular to a center axis line 0; when the outer peripheral edge of the tip-end surface is rounded or chamfered, a wall thickness at the base-end position of the rounded portion or chamfered portion): 0.2 to 3 mm; and mean wall thickness tA ((t1+t2)/2) of second stem portion 2*i*: 0.25 to 3.25 mm.

Also, in FIG. 1, the length LQ of a portion 2*k* protruding rearward of the metallic shell 1 of the insulator 2 is 23 to 27 mm (e.g., approx. 25 mm). Further, when a longitudinal section including the center axis line O of the insulator 2 is taken, in the outer circumferential surface of the protruding portion 2*k* of the insulator 2, a length LP measured along the profile of the cross section from a position corresponding to the rear end edge of the metallic shell 1, through the corrugation 2*c*, to the rear end edge of the insulator 2 is 26 to 32 mm (e.g., approx. 29 mm). In addition, the dimensions of individual parts in the insulator 2 shown in FIG. 4A are, for example, as follows: L1=approx. 60 mm, L2=approx. 10 mm, L3=approx. 14 mm, D1=approx. 11 mm, D2=approx. 13 mm, D3=approx. 7.3 mm, D4=5.3 mm, D5=4.3 mm, D6=3.9 mm, D7=2.6 mm, t1=1.7 mm, t2=1.35 mm, t3=0.9 mm, tA=1.2 mm.

Also, in the insulator 2 shown in FIG. 4B, the first stem portion 2*g* and the second stem portion 2*i* have outer diameters slightly larger than those of the insulator 2 shown in FIG. 4A. The dimensions of individual parts are, for example, as follows: L1=approx. 60 mm, L2=approx. 10 mm, L3=approx. 14 mm, D1=approx. 11 mm, D2=approx. 13 mm, D3=approx. 9.2 mm, D4=6.9 mm, D5=5.1 mm, D6=3.9 mm, D7=2.7 mm, t1=2.65 mm, t2=2.1 mm, t3=1.2 mm, tA=2.4 mm.

Reverting to FIG. 1, the metallic shell 1 is formed from low carbon steel or other metal into a cylindrical shape, constituting a housing for the sparkplug 100, and a screw portion 7 for mounting the spark plug 100 to an unshown engine block is formed at the outer circumferential surface of the metallic shell 1. The outer diameter of this screw portion 7 is made to be not more than 18 mm (for example, 18 mm, 14 mm, 12 mm, 10 mm, etc.). In addition, reference numeral le denotes a hexagon for tool engagement.

Figure 3:
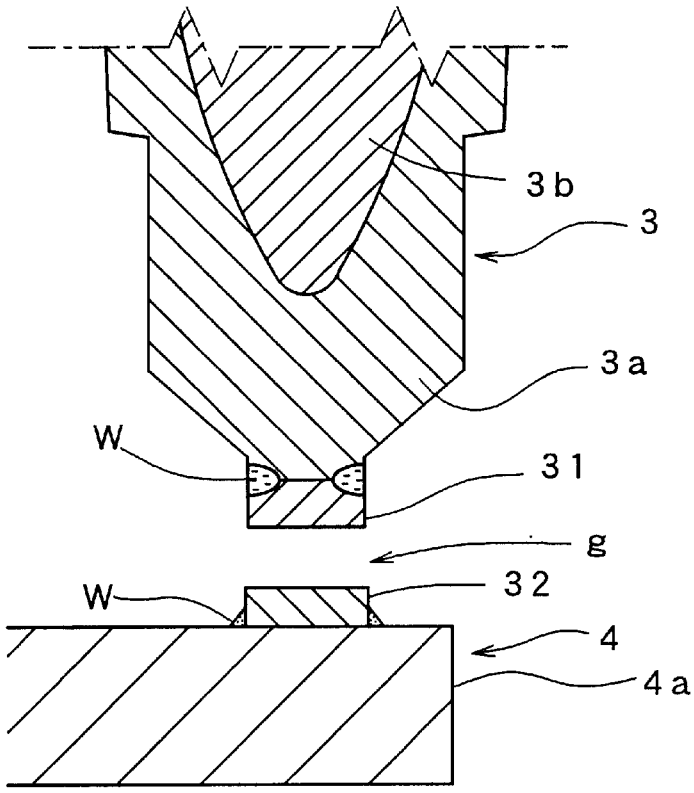
FIG. 3 is a sectional view showing, under enlargement, a vicinity of the igniter portion of FIG. 2.

Next, as shown in FIG. 3, shell portions 3*a* and 4*a* of the center electrode 3 and the ground electrode 4 are made of Ni alloy or the like such as Inconel (trademark). Also, inside the center electrode 3, is buried a core material 3*b* made of Cu or Cu alloy or the like for acceleration of heat radiation. On the other hand, the igniter portion 32 opposite to the igniter portion 31 is made mainly of a noble metal alloy composed mainly of one or more kinds selected from among Ir, Pt and Rh. The shell portion 3*a* of the center electrode 3 is reduced in diameter on the front end side, and its front end surface is formed flat. A disc-shaped chip made of an alloy composition constituting the igniter portion is overlapped, and further a welded portion W is formed and fixed along its junction-surface outer edge portion by laser welding, electron beam welding, resistance welding or the like, by which the igniter portion 31 is formed. Also, the opposite igniter portion 32 is formed by aligning a chip with the ground electrode 4 at a position corresponding to the igniter portion 31, and forming and fixing a welded portion W similarly along its junction-surface outer edge portion. These chips may be formed of a solution obtained by blended and dissolving alloy components so as to form the above compositions, or of a sintered material obtained by molding and sintering an alloy powder or a metal component powder blended at a specified ratio. In addition, it is also possible to omit at least either one of the igniter portion 31 and the igniter portion 32.

The insulator 2 is fabricated by, for example, the following process. First, as the material powder, alumina powder having a mean particle size of not more than 1 $\mu$m, and additional-element materials of Si component, Ca component, Mg component, Ba component and B component are blended at a specified ratio that leads to the aforementioned composition in oxide-converted ratio, and further hydrophilic binder (e.g., PVA) and water are added and mixed, by which a molding-base slurry is made. In addition, the additional-element materials may be blended in the form of, for example, $SiO_2$ powder for Si component, $CaCO_3$ powder for Ca component, MgO powder for Mg component, $BaCO_3$ powder for Ba component, $H_3BO_3$ powder (or aqueous solution) for B component.

Figure 10:
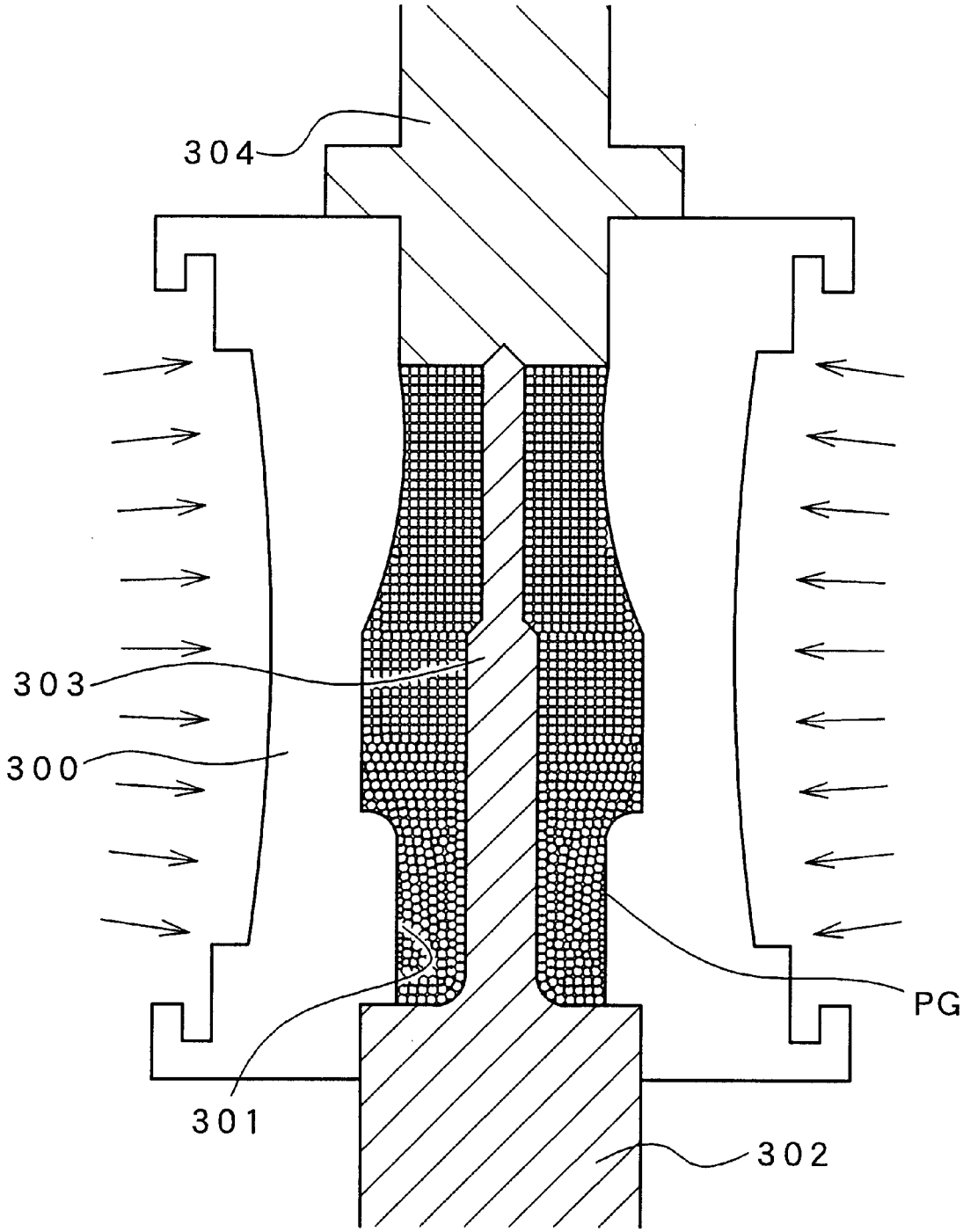
FIG. 10 is an explanatory view for rubber pressing process.

The molding-base slurry is sprayed and dried by spray drying process or the like so as to be formed into a molding-base granulated substance. Then, the molding-base granulated substance is rubber-press molded to form a press-molded body that makes the primitive form of the insulator. FIG. 10 schematically shows the process of rubber press molding. In this case, a rubber die 300 having a cavity 301 axially passing through inside are used, and an upper punch 304 is fitted to the upper-side opening portion of the cavity 301. Also, in the punching surface of a lower punch 302, is integrally provided a press pin 303 that axially extends within the cavity 301 and that determines the shape of the through hole 6 of the insulator 2 (FIG. 1).

In this state, a specified amount of molding-base granulated substance PG is filled in the cavity 301, and the upper-side opening of the cavity 301 is closed and sealed by the upper punch 304. In this state, a liquid pressure is applied to the outer circumferential surface of the rubber die 300, and the granulated substance PG of the cavity 301 is compressed via the rubber die 300, by which a press molded body is obtained. For the press molding of the molding-base granulated substance PG, with the weight of the molding-base granulated substance PG assumed to be 100 parts by weight, 0.7 to 1.3 parts by weight of water content is added, the molding-base granulated substance PG is pressed so that the cracking of the molding-base granulated substance PG into powder particles in the pressing process is accelerated.

As to the press molded body, its outer surface side is machined by grinder cutting or the like, so as to be finished into, for example, an outer shape corresponding to the insulator 2 of FIG. 1, and subsequently fired at a temperature of 1400 to 1600° C. After that, the press molded body is coated with glaze and finally baked, thus be completed.

Now the function of the spark plug 100 is explained. The spark plug 100 is mounted to an engine block at its screw portion 7, and used as an ignition source to the air-fuel mixture supplied to the combustion chamber. In this case, on the basis that the insulator 2 used in the spark plug 100 is implemented by the insulator of the present invention, voltage endurance at high temperatures is improved and, even when the insulator is applied to a high output power engine which involves high temperatures within the combustion chamber, dielectric breakdowns are less likely to occur, so that a high reliability can be ensured.

For example, as shown in FIGS. 4A and 4B, when the insulator 2 has, on the front side of the engagement protruding portion 2*e*, a stem portion (in this case, a portion of combined first stem portion 2*g* and second stem portion 2*i*) smaller in diameter and thinner in radial thickness than the engagement protruding portion 2*e* formed, it becomes more likely that through breakdowns at this stem portion, for example at the second stem portion 2*i*. Accordingly, in such an insulator 2, the aforementioned advantages of the insulator for spark plugs according to the present invention can be fulfilled particularly effectively. For example, in the insulator of FIG. 4B, in which the mean thickness of the second stem portion 2*i* is made to be not more than 2.4 mm with a view to improving the thermal resistance by heat-radiation improvement, even if such a small-thickness portion is formed around the center electrode 3, occurrence of troubles such as through breakdowns can be effectively prevented or suppressed by virtue of the application of the insulator for spark plugs according to the present invention.

Figure 5:
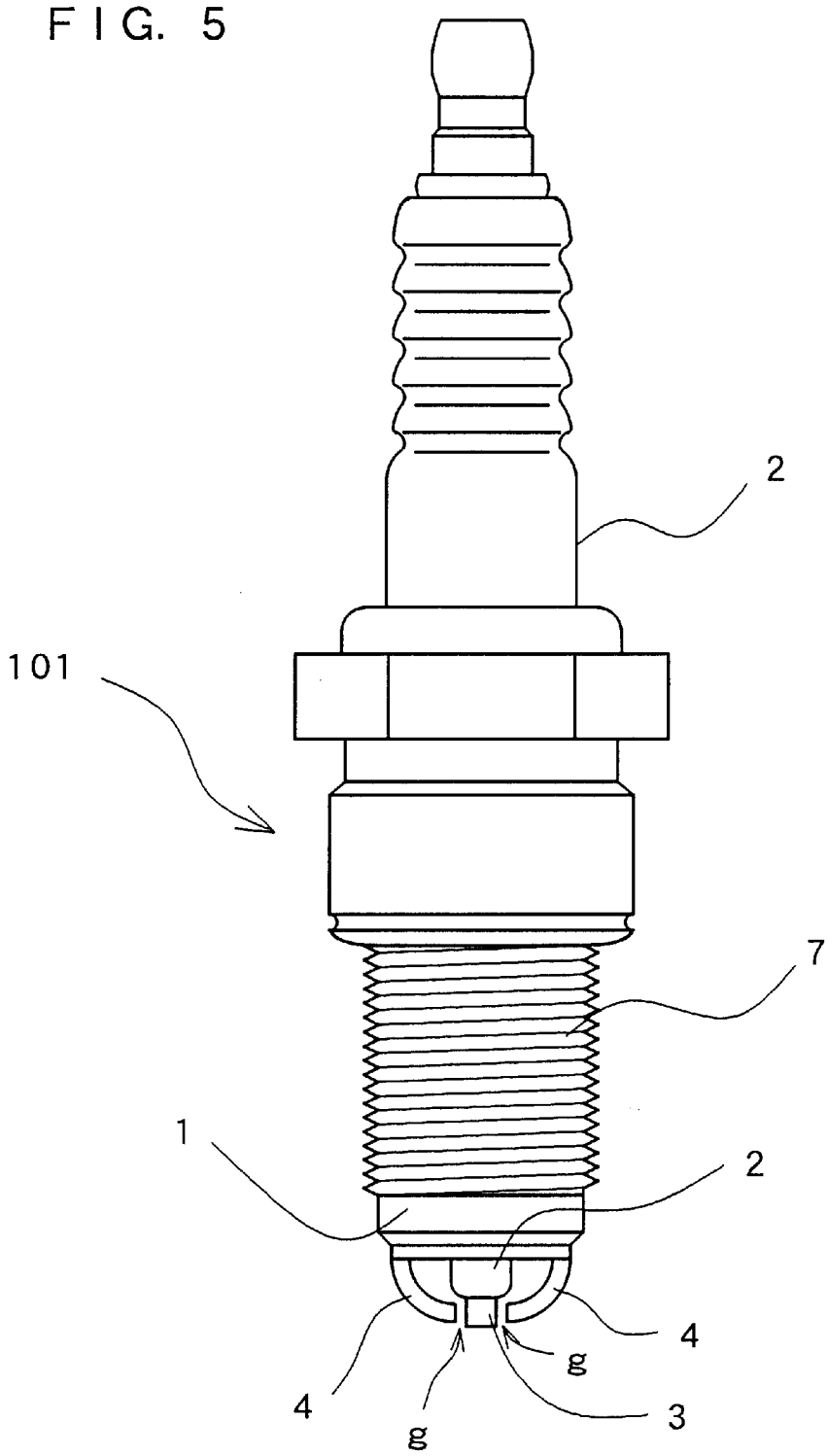
FIG. 5 is a general front view showing another example of the spark plug of the present invention.
Figure 6A:
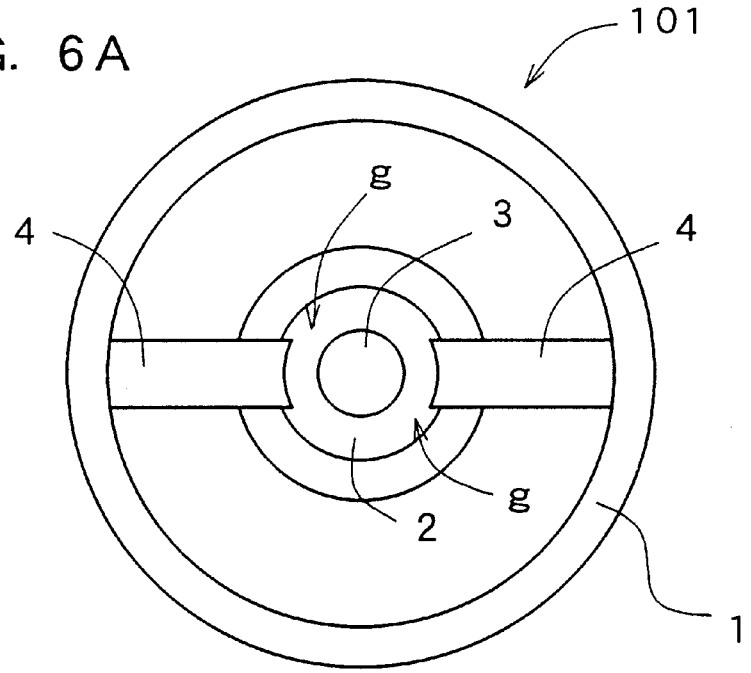
FIG. 6A is a plan view of FIG. 5.
Figure 6B:
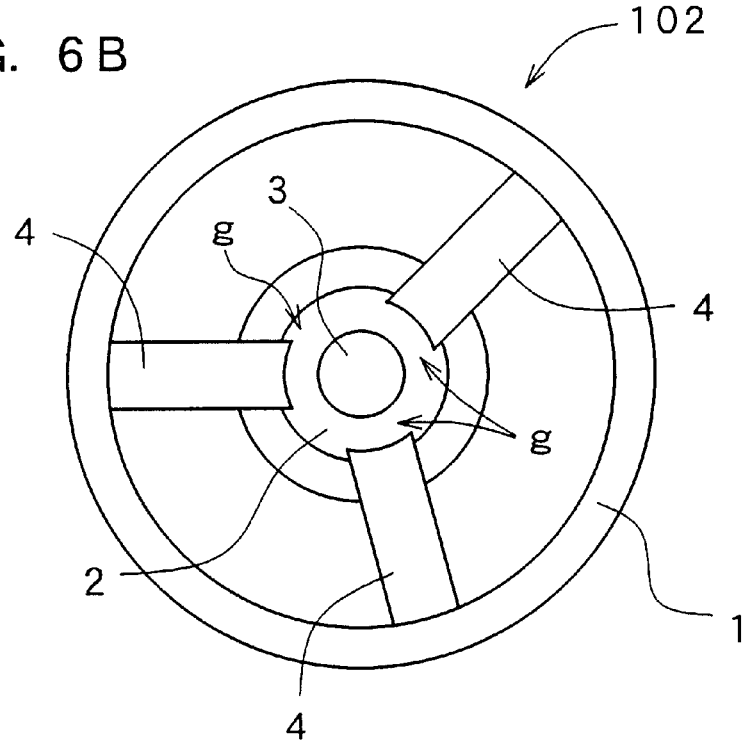
FIG. 6B is a plan view showing a modification example of FIG. 5.

The spark plugs to which the insulator of the present invention can be applied are not limited to those of the type shown in FIG. 1, and may be ones in which the tip end of the ground electrode 4 is opposed to the side face of the center electrode 3 with a spark gap g formed therebetween, for example, as shown in FIG. 5. In this case, in one embodiment, the ground electrode 4 may be provided on both sides of the center electrode 3, one for each side, totally two, while in other embodiments, three or more ground electrodes 4 may be provided around the center electrode 3 as shown in FIG. 6B.

Figure 7:
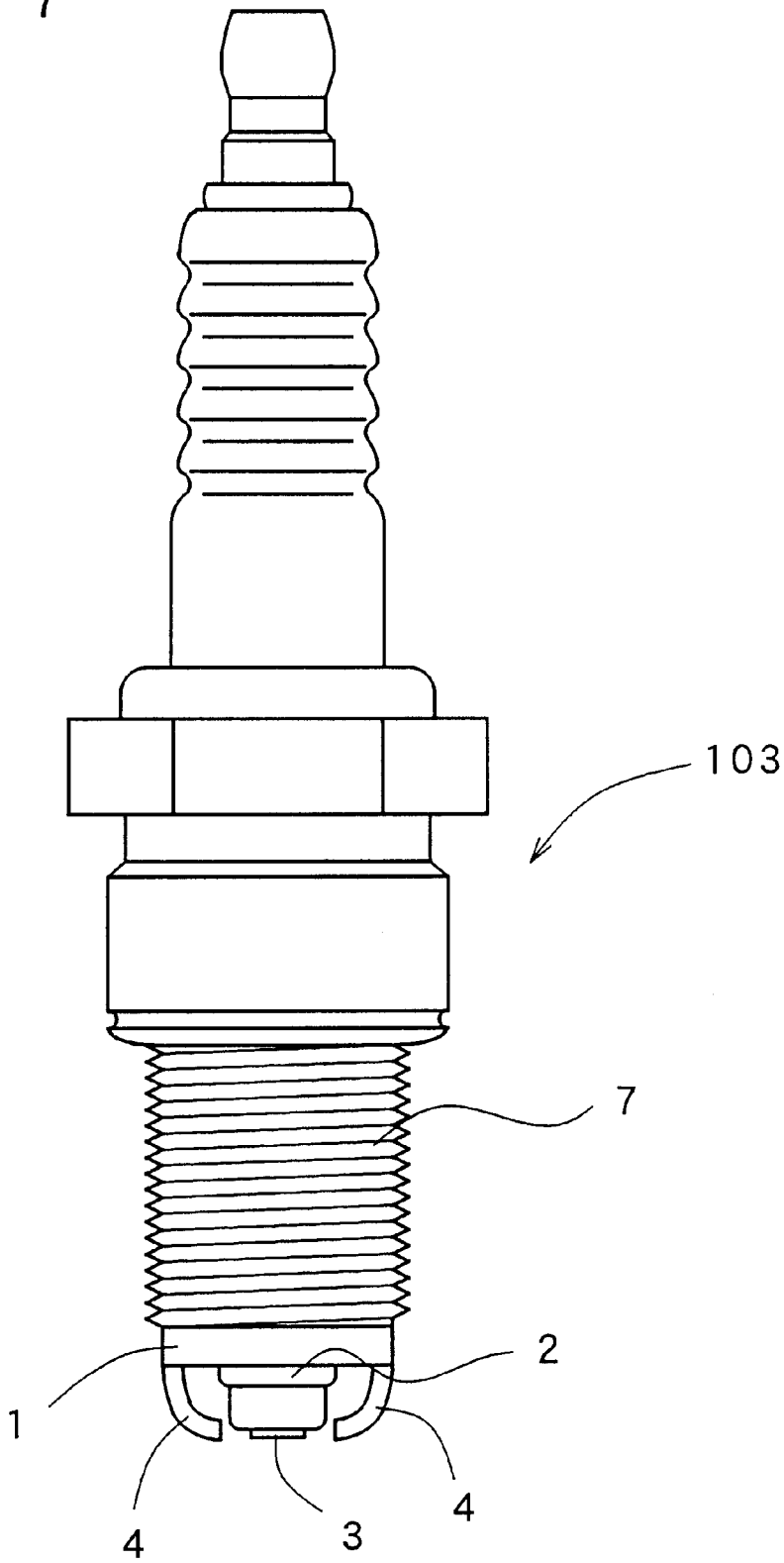
FIG. 7 is a general front view showing yet another example of the spark plug of the present invention.

In this case, as shown in FIG. 7, the spark plug 103 may be provided as a semi surface creeping discharge type spark plug in which the tip-end portion of the insulator 2 is advanced to enter between the side face of the center electrode 3 and the tip-end portion of the ground electrode 4. In this constitution, spark discharge occurs so as to creep the surface of the tip-end portion of the insulator 2, so that the anti-fouling characteristics is improved as compared with the spark plug of the air discharge type.

EXAMPLES

In order to establish the performance of the insulators of the present invention, the following experiments were conducted.

Example 1

$Al_2O_3$ powder (purity: 99.9%, mean particle size: 0.6 to 2 μm), $SiO_2$ powder (purity: 99%, mean particle size: 2 μm), CaO powder (purity: 99%, mean particle size: 2 μm), MgO powder (purity: 99%, mean particle size: 2 μm), BaO powder (purity: 99%, mean particle size: 2 μm), and $B_2O_3$ powder (purity: 99%, mean particle size: 2 μm) were blended at various ratios, and to this blend, specified amounts of binder and water were added and wet blended, and then dried by spray drying, by which a granulated material powder was prepared (Nos. 1–8). The grain size of each powder was measured by using a laser diffraction type grain size meter. Next, this granulated powder was press molded into a specified form by die pressing, and the molded body was fired at 1600° C. for one hour, by which the following test pieces were made:

Test piece A: 25 mm dia.×0.7 mm thick disc shape; and

Test piece B: 10 mm dia.×1 mm thick disc shape.

Figure 11:
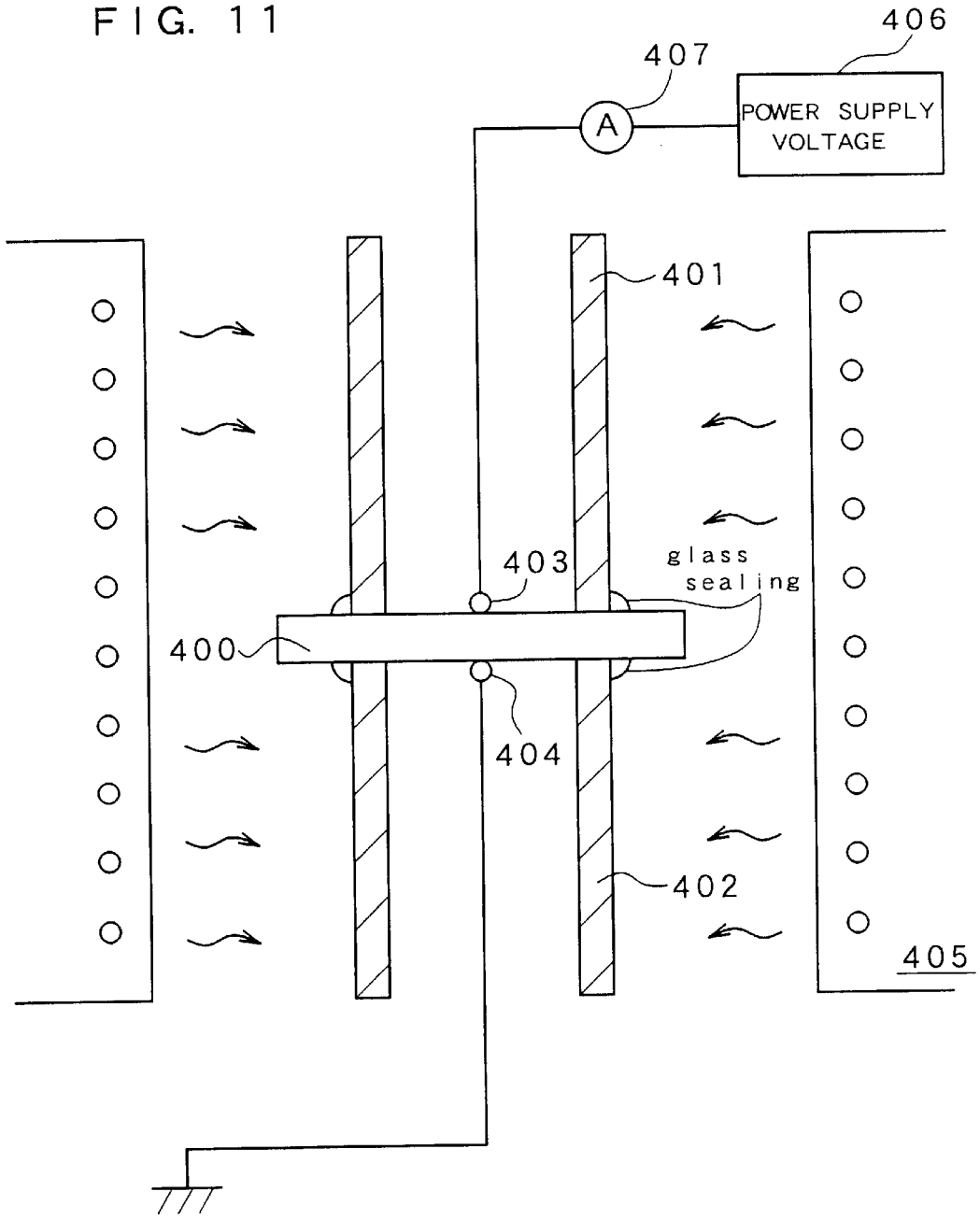
FIG. 11 is a schematic view showing a system for measuring insulation resistance of the insulator.

With the test piece A out of these, insulation resistance value at high temperature was measured by a measuring system shown in FIG. 11. As to the process, more specifically, on both sides of a disc-shaped sample 400, alumina insulating tubes 401, 402 are bonded with outer diameter 10 mm, inner diameter 6 mm and length 70 mm, and electrodes 403, 404 are inserted inside those insulating tubes so as to be brought into contact with both sides of the sample 400, and further the whole unit is heated to 700° C. in an oven 405. Then, in this state, the sample 400 is electrified via the electrodes 403, 404 by a DC constant-voltage power supply (power supply voltage: 1000 V) 406, where the insulation resistance is measured from the resulting condition current value (measured by an ammeter 407). Further, measurement of thermal conductivity for the test piece B was conducted by laser flash process.

Of the test piece B after the thermal conductivity measurement, the surface was ground and observed by a scanning electron microscope (magnifying power: 150), where the number of voids having a size of not less than 10 μm which had appeared on the ground surface were counted by image analysis. Then, the confirmed number of voids was divided by the total area of observation field of view, by which a void presence rate per $mm^2$ was determined. Also, particle size distribution of the alumina base principal phase was measured similarly by image analysis, by which the area ratio of 20 μm or larger particles was calculated. Further, contents of the individual components, Al, Si, Ca, Mg, Ba and B, in each test piece were analyzed by ICP process, and calculated in weight converted into oxide (unit: wt %).

Next, with the granulated material powders, the rubber press process as described with FIG. 10 was conducted at a press of 50 MPa, and the outer circumferential surface of the molded body was ground by a grinder so as to be formed into a specified insulator shape, and then fired at 1600° C. for one hour. Thus, an insulator 2 made of alumina insulator having the same configuration as in FIG. 1 was obtained.

Dimensions of individual parts of the insulator 2 shown with the aid of FIG. 4A are as follows: L1=approx. 60 mm, L2=approx. 10 mm, L3=approx. 14 mm, D1=approx. 11 mm, D2=approx. 13 mm, D3=approx. 7.3 mm, D4=5.3 mm, D5=4.3 mm, D6=3.9 mm, D7=approx. 2.6 mm, t1=1.7 mm, t2=1.35 mm, t3=0.9 mm, tA=1.5 mm. Further, with the aid of FIG. 1, the length LQ of the portion 2*k* protruding rearward of the metallic shell 1 of the insulator 2 is 25 mm. When a longitudinal section including the center axis line O of the insulator 2 is taken, in the outer circumferential surface of the protruding portion 2*k* of the insulator 2, the length LP measured along the profile of the cross section from a position corresponding to the rear end edge of the metallic shell 1, through the corrugation 2*c*, to the rear end edge of the insulator 2 is 29 mm.

With these insulators 2, the spark plug 100 as shown in FIG. 1 was prepared in various types, where the outer diameter of the screw portion 7 was 12 mm and the terminal 13 and the center electrode 3 were directly joined via an electrically conductive glass seal layer without using the resistor 15. These spark plugs 100 were subjected to the following tests:

(1) through-in-oil breakdown voltage at 20° C.: measured by the CDI method (rise time: 50 μsec) as a high-voltage power supply with the process already explained with FIG. 9;

(2) actual voltage endurance test: with each of the spark plugs mounted to a four-cylinder gasoline engine (displacement: 660 cc), the engine was thrown into a continuous running with the throttle fully opened, at an engine speed of 6000 rpm with a discharge voltage of 35 kV, and the actual voltage endurance was evaluated by the resulting running time (maximum up to 50 hours) continued until a spark passage (through break down) occurred. As the evaluation criteria, those which yielded a spark passage in less than 40 hours were evaluated as x (impermissible), those which yielded a sparkpassage in 40 to 50 hours as Δ (permissible), and those which showed no passage after an elapse of 50 hours were evaluated as o (good) Results of these are shown in Table 1A and Table 1B:

TABLE 1A

| No. | Mean particle size of alumina powder (μm) | Composition (wt % oxide-converted value) $Al_2O_3$ | $SiO_2$ | CaO | MgO | BaO | $B_2O_3$ | Alumina base principal phase Area ratio of 20 μm or larger particles (%) |
|---|---|---|---|---|---|---|---|---|
| 1 | 0.6 | 95 | 2.40 | 2.00 | 0.10 | 0.26 | 0.24 | 52 |
| 2 | 0.6 | 97 | 1.45 | 1.20 | 0.05 | 0.16 | 0.14 | 68 |
| 3 | 0.6 | 99 | 0.50 | 0.40 | 0.02 | 0.04 | 0.04 | 85 |
| 4 | 0.6 | 99.7 | 0.15 | 0.12 | 0.01 | 0.02 | 0.01 | 88 |
| 5* | 0.6 | 100 | — | — | — | — | — | 91 |
| 6 | 1.0 | 97 | 1.45 | 1.20 | 0.05 | 0.16 | 0.14 | 53 |
| 7* | 1.5 | 95 | 2.40 | 2.00 | 0.10 | 0.26 | 0.24 | 29 |
| 8* | 2.0 | 95 | 2.40 | 2.00 | 0.10 | 0.26 | 0.24 | 36 |

Nos. marked * are departed from the scope of the present invention.

TABLE 1B

| No. | Void Rate (number/mm²) | Through-in-oil breakdown voltage at 20° C. (kv) | Actual voltage endurance test | Thermal conductivity (25° C.) W/m/ · K | Insulation resistance (MΩ) |
|---|---|---|---|---|---|
| 1 | 91 | 38 | Δ | 24 | 2500 |
| 2 | 85 | 41 | ○ | 28 | 5200 |
| 3 | 52 | 45 | ○ | 34 | 11700 |
| 4 | 51 | 43 | ○ | 35 | 12500 |
| 5* | 162 | 30 | X | 23 | 1600 |
| 6 | 92 | 38 | Δ | 26 | 3500 |
| 7* | 109 | 34 | X | 24 | 2000 |
| 8* | 127 | 35 | X | 24 | 1800 |

Nos. marked * are departed from the scope of the present invention.

In conclusion, it can be understood that, by using a raw material alumina powder having a mean particle size of not more than 1 μm, the presence number of voids with size not less than 10 μm per mm² as observed in a cross-sectional structure of the resulting insulator becomes not more than 100 so that the area ratio occupied by alumina base principal-phase particles with particle size not less than 20 μm can be made not less than 50% (desirably, not less than 60%) (Nos. 1–4, 6). Insulation resistance values at 700° C. of these insulators are as high as 2000 MQ, and besides the insulators of Nos. 2–4 and 6 have showed large values as much as 25 W/m·K or more. Also, it can be understood that the spark plugs in which the insulators are implemented by these insulators were able to obtain successful results in the actual voltage endurance test.

What is claimed is:

1. A spark plug comprising:

a center electrode;

a metallic shell placed outside the center electrode;

a ground electrode which has one end coupled to the metallic shell and which is placed opposite to the center electrode; and an insulator placed between the center electrode and the metallic shell so as to cover exterior of the center electrode, wherein the insulator is made of an insulating material which is composed mainly of alumina, which contains Al component within a range of 95 to 99.7 wt % in $Al_2O_3$-converted weight, and in which an area ratio occupied by alumina base principal-phase particles with particle size not less than 20 μm is not less than 50% as a cross-sectional structure of the insulator is observed.

2. A spark plug according to claim 1, wherein with respect to the insulating material forming the insulator, a mean presence number of voids having a size of not less than 10 μm per mm² in a cross section observed in cross-sectional structure is not more than 100.

3. A spark plug according to claim 1, wherein with respect to the insulating material forming the insulator, Al component is contained within a range of 95 to 99.7 wt % in $Al_2O_3$-converted weight, and its thermal conductivity at 25° C. is not less than 25 W/m·K.

4. A spark plug according to claim 1, wherein the insulating material contains 0.02 to 0.3 wt % of Ba component in BaO-converted weight.

5. A spark plug according to claim 1, wherein the insulating material contains 0.01 to 0.25 wt % of B component in $B_2O_3$-converted weight.

6. A spark plug according to claim 1, wherein the insulating material contains:

0.15 to 2.5 wt % of Si component in $SiO_2$-converted weight;

0.12 to 2.0 wt % of Ca component in CaO-converted weight;

0.01 to 0.1 wt % of Mg component in MgO-converted weight;

0.02 to 0.3 wt % of Ba component in BaO-converted weight; and 0.01 to 0.25 wt % of B component in $B_2O_3$-converted weight.

7. A spark plug according to claim 1, wherein a mounting screw portion formed in the metallic shell has outer diameter not more than 12 mm.

8. A spark plug comprising:

a center electrode;

a metallic shell placed outside the center electrode;

a ground electrode which has one end coupled to the metallic shell and which is placed opposite to the center electrode; and an insulator placed between the center electrode and the metallic shell so as to cover exterior of the center electrode, wherein the insulator is made of an insulating material which is composed mainly of alumina, which contains Al component within a range of 95 to 99.7 wt % in $Al_2O_3$-converted weight, and in which a mean presence number per mm in a cross section of voids having a size of not less than 10 $\mu$m observed in cross-sectional structure is less than 100.

9. A sparkplug according to claim 8, wherein with respect to the insulating material forming the insulator, Al component is contained within a range of 95 to 99.7 wt % in $Al_2O_3$-converted weight, and its thermal conductivity at 25° C. is not less than 25 W/m·K.

10. A spark plug according to claim 8, wherein the insulating material contains 0.02 to 0.3 wt % of Ba component in BaO-converted weight.

11. A spark plug according to claim 8, wherein the insulating material contains 0.01 to 0.25 wt % of B component in $B_2O_3$-converted weight.

12. A spark plug according to claim 8, wherein the insulating material contains:

0.15 to 2.5 wt % of Si component in $SiO_2$-converted weight;

0.12 to 2.0 wt % of Ca component in CaO-converted weight;

0.01 to 0.1 wt % of Mg component in Mgo-converted weight;

0.02 to 0.3 wt % of Ba component in BaO-converted weight; and 0.01 to 0.25 wt % of B component in $B_2O_3$-converted weight.

13. A spark plug according to claim 8, wherein a mounting screw portion formed in the metallic shell has outer diameter not more than 12 mm.

14. A process for fabricating a spark plug according to claim 1 including preparing an insulator for spark plugs comprising:

preparing a raw material base powder (PG) by blending alumina powder having a mean particle size of not more than 1 $\mu$m with 0.3 wt % of additional-element material serving as sintering aids in a ratio relative to a total of the alumina powder and the additional-element material;

molding the raw material base powder (PG) into a specified insulator configuration; and firing the molded body at a temperature of 1450 to 1700° C., whereby an insulator which is composed mainly of alumnia, which contains A1 component within a range of 95 to 99.7 wt % in $Al_2O_3$-converted weight, and in which an area ratio occupied by alumina base principal-phase particles with particle size not less than 20 $\mu$m is not less than 50% as a cross-sectional structure of the insulator is observed is obtained.

15. A process for fabricating a spark plug including the insulator for spark plugs according to claim 14, wherein as the additional-element material, 0.15 to 2.5 wt % of Si component in $SiO_2$-converted weight;

0.12 to 2.0 wt % of Ca component in CaO-converted weight;

0.01 to 0.1 wt % of Mg component in MgO-converted weight;

0.02 to 0.3 wt % of Ba component in BaO-converted weight; and 0.01 to 0.25 wt % of B component in $B_2O_3$-converted weight are blended in a ratio relative to a total of the alumina powder and the additional-element material.

16. A process for fabricating a spark plug according to claim 1 including preparing an insulator for spark plugs comprising:

preparing raw material base powder (PG) by blending alumina powder having a mean particle size of not more than 1 $\mu$m with 0.3 to 5 wt % of additional-element material serving as sintering aids in a ratio relative to a total of the alumina powder and the additional-element material;

molding the raw material base powder (PG) into a specified insulator configuration; and firing the molded body at a temperaure of 1450 to 1700° C., whereby an insulator which is composed mainly of alumina, which contains Al component within a range of 95 to 99.7 wt % in $Al_2O_3$-converted weight, and in which a mean presence number per $mm^2$ in a cross section of voids having a size of not less than 10 $\mu$m observed in cross-sectional structure is less than 100 is obtained.

17. A process for fabricating a spark plug including the insulator for spark plugs according to claim 16, wherein as the additional-element material, 0.15 to 2.5 wt % of Si component in $SiO_2$-converted weight;

0.12 to 2.0 wt % of Ca component in CaO-converted weight;

0.01 to 0.1 wt % of Mg component in MgO-converted weight;

0.02 to 0.3 wt % of Ba component in BaO-converted weight; and 0.01 to 0.25 wt % of B component in $B_2O_3$-converted weight are blended in a ratio relative to a total of the alumina powder and the additional-element material.

* * * * *